US006152346A

United States Patent [19]

Laubach

[11] Patent Number: 6,152,346

[45] Date of Patent: Nov. 28, 2000

[54] ADJUSTABLE MAGAZINES FOR NAIL TOOLS AND METHODS THEREFOR

[75] Inventor: Marco Laubach, Gurnee, Ill.

[73] Assignee: Illinois Tool Work Inc., Glenview, Ill.

[21] Appl. No.: 09/317,576

[22] Filed: May 24, 1999

[51] Int. Cl.[7] ..... B25C 1/04

[52] U.S. Cl. ..... 227/109; 227/136; 227/137

[58] Field of Search ..... 227/109, 135, 227/136, 137, 120, 128

[56] References Cited

U.S. PATENT DOCUMENTS

| | | | |
|---|---|---|---|
| 3,259,292 | 7/1966 | Maynard . | |
| 3,330,462 | 7/1967 | Colechia et al. . | |
| 3,506,115 | 4/1970 | Heilman . | |
| 3,568,908 | 3/1971 | Bader . | |
| 3,664,565 | 5/1972 | Heilman . | |
| 3,688,966 | 9/1972 | Perkins et al. . | |
| 3,945,551 | 3/1976 | Sato et al. . | |
| 4,433,782 | 2/1984 | Figge et al. . | |
| 4,518,109 | 5/1985 | Shiroyama . | |
| 4,585,154 | 4/1986 | Fealey et al. . | |
| 4,669,648 | 6/1987 | Monacelli . | |
| 5,634,582 | 6/1997 | Morrison, Jr. et al. | 227/136 |
| 5,683,024 | 11/1997 | Eminger et al. . | |
| 5,697,541 | 12/1997 | Burke et al. | 227/109 |

*Primary Examiner*—Scott A. Smith
*Attorney, Agent, or Firm*—Lisa M. Soltis; Mark W. Croll; John P. O'Brien

[57] ABSTRACT

A magazine for a coiled strip of nails useable in nailing tools, combinations thereof and methods therefor, having generally a magazine tray with an inner post having a recessed axial slot formed therein, and a nail plate having an outer post extending therefrom. The outer post is reciprocatingly disposed about the inner post, and a pin disposed through the outer post is biased so that an enlarged head thereof is biased into a recess of the axial slot to axially fix the nail plate relative to the inner post.

19 Claims, 3 Drawing Sheets

ADJUSTABLE MAGAZINES FOR NAIL TOOLS AND METHODS THEREFOR

BACKGROUND OF THE INVENTION

The invention relates generally to nailing tools, and more particularly to adjustable magazines for nailing tools, combinations thereof, and methods therefor.

It is known generally to supply fasteners, for example trim nails, from a coiled strip of fasteners housed in a magazine of a fastener driving tool, for example a trim nailing tool. The coiled strip of fasteners includes generally a plurality of individual fasteners arranged and held in parallel, spaced apart relation by a flexible carrier formable in a coil and disposed in the magazine as is well known in the art.

It is also known to provide a magazine with an adjustable fastener support plate for accommodating coiled strips of fasteners having different sizes, and more particularly different axial lengths. Prior art FIG. 4 of the present application, for example, illustrates one known prior art adjustable magazine 10 comprising generally a magazine tray 12 having a nail plate 14 adjustably disposed therein for supporting a coiled strip of nails thereon. The magazine tray 12 has an inner post 16 coupled thereto and protruding from a central portion thereof. An outer post 18 is coupled to a central portion of the nail plate 14 and is disposed concentrically about the inner post 16. The outer post 18 is generally reciprocatingly adjustable relative to the inner post 16 to raise and lower the nail plate 14 to accommodate different sized nails. The inner post 16 is coupled to the outer post 18 by a stretched spring 20 disposed vertically therein. A first end of the spring is coupled to a cap 22 disposed on an end of the outer post 18, and a second end of the spring 20 is coupled to the inner post 16, thereby retaining the cap 22 on the outer post 18 and biasing the nail plate 14 downwardly relative to the inner post 16. The outer post 18 includes inner bosses that move along a series of grooves with pockets formed on the inner post 16, and the spring 20 biases the outer post 18 downwardly relative to the inner post 16 to retain the bosses in corresponding pockets.

The prior art adjustable magazine of FIG. 4 and other adjustable magazines however have a limited range of adjustability, thereby limiting the range of fastener sizes that may be disposed in or accommodated by the magazine. In prior art FIG. 4 discussed above, the range of nail plate 14 adjustability is limited in part by the outer post 18 and cap 22 thereof, which eventually abut against a cover 24 disposed over the magazine tray 12 when the nail plate 14 is raised sufficiently upwardly relative to the inner post 16 to accommodate shorter fasteners or nails in the magazine.

The invention is drawn toward advancements in the art of magazines useable for housing coiled strips of fasteners in fastener driving tools, for example trim nailing tools.

An object of the invention is to provide novel magazines for fastener driving tools, combinations thereof, and methods therefor that overcome problems in the art.

Another object of the invention is to provide novel magazines for fastener driving tools, combinations thereof, and methods therefor that are economical and reliable.

Another object of the invention is to provide novel magazines for fastener driving tools, combinations thereof, and methods therefor having an increased range of adjustability for accommodating different sized fasteners.

A further object of the invention is to provide novel magazines for fastener driving tools and combinations thereof that eliminate the cap on the outer post and that eliminate the stretched spring coupling the inner and outer posts of known magazines.

A more particular object of the invention is to provide novel magazines for coiled strips of nails useable in nailing tools, combinations thereof and methods therefor, comprising generally a magazine tray having an inner post with a recessed axial slot formed therein, and a nail plate having an outer post extending therefrom. The outer post is reciprocatingly disposed about the inner post, and a pin disposed through the outer post is biased so that an enlarged head thereof is biased into a recess of the axial slot to axially fix the nail plate relative to the inner post, whereby the nail plate is adjustably movable relative to the inner post when the enlarged head is unseated from the recess of the axial slot.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
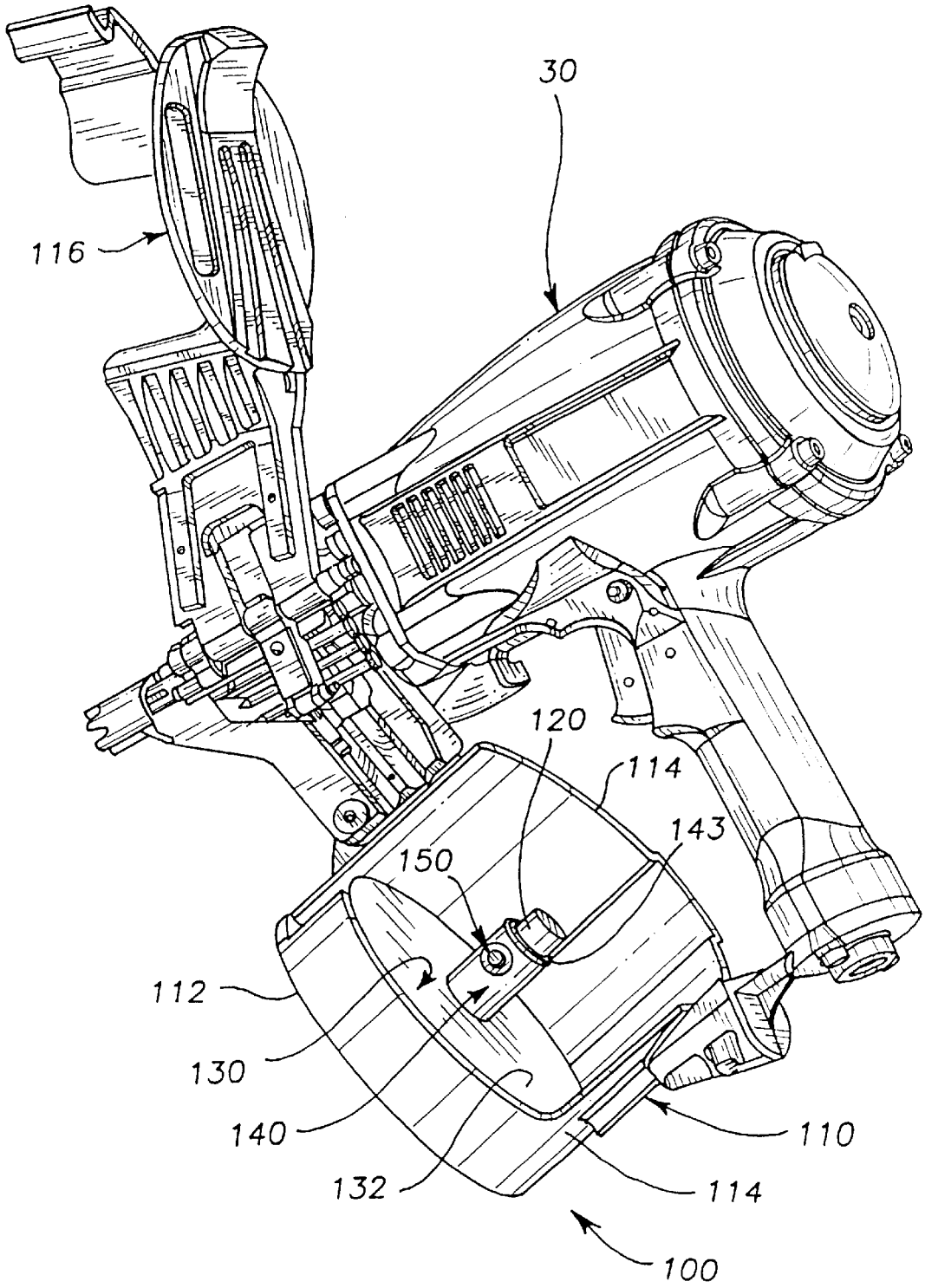
FIG. 1 is an exemplary nailing tool having a magazine for a coiled strip of nails according to the invention.

FIG. 1 is a fastener driving tool 30 having a magazine 100 useable for housing a coiled strip of fasteners, which are supplied therefrom to a nose-piece of the tool for installation into a workpiece, as is well known generally. The tool 30 of the exemplary embodiment is a trim nailing tool, Model No. 4250/65C available from ITW Paslode, Vernon Hills, Ill. The magazine 100 of the invention may be used more generally in combination with any fastener driving tool, and in other applications where it is desirable to house a coiled strip of fasteners or other similar articles.

Figure 2:
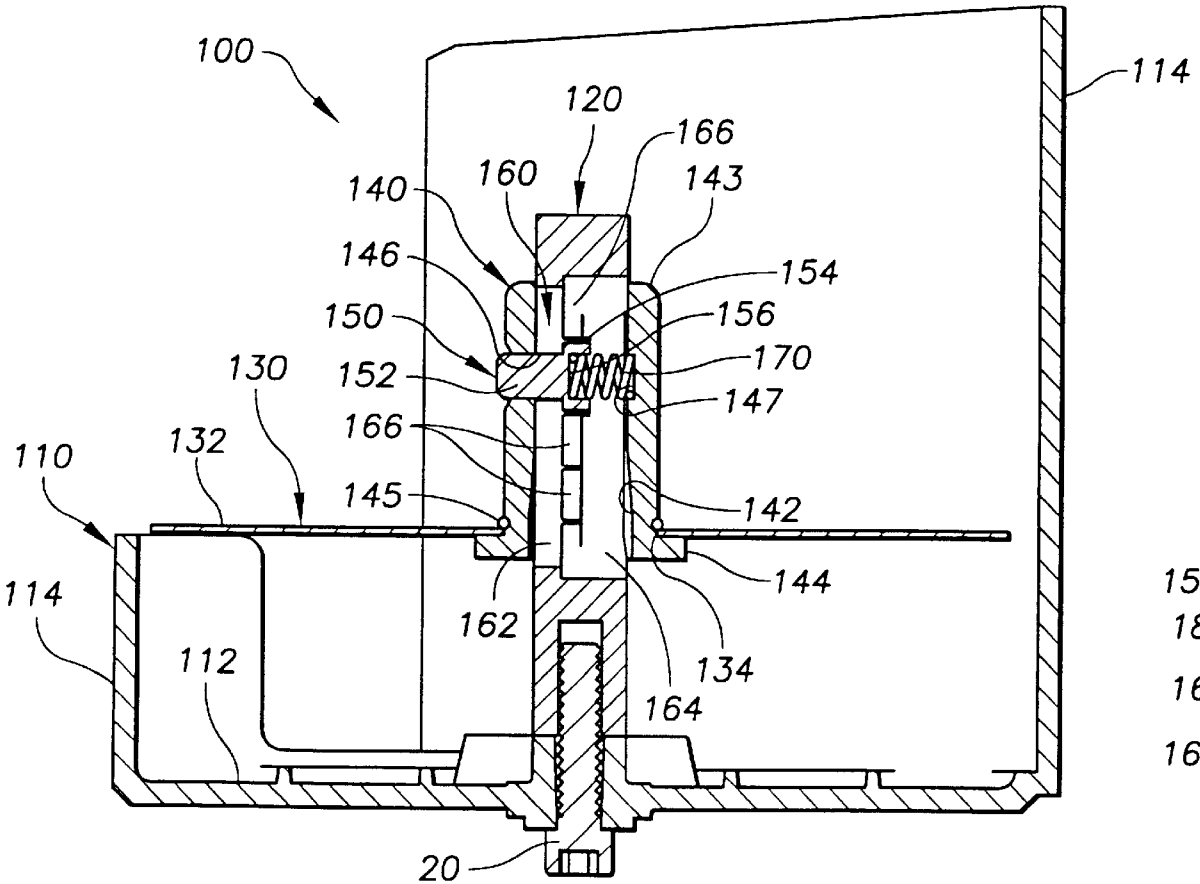
FIG. 2 is a partial sectional view of a magazine according to the invention.
Figure 4:
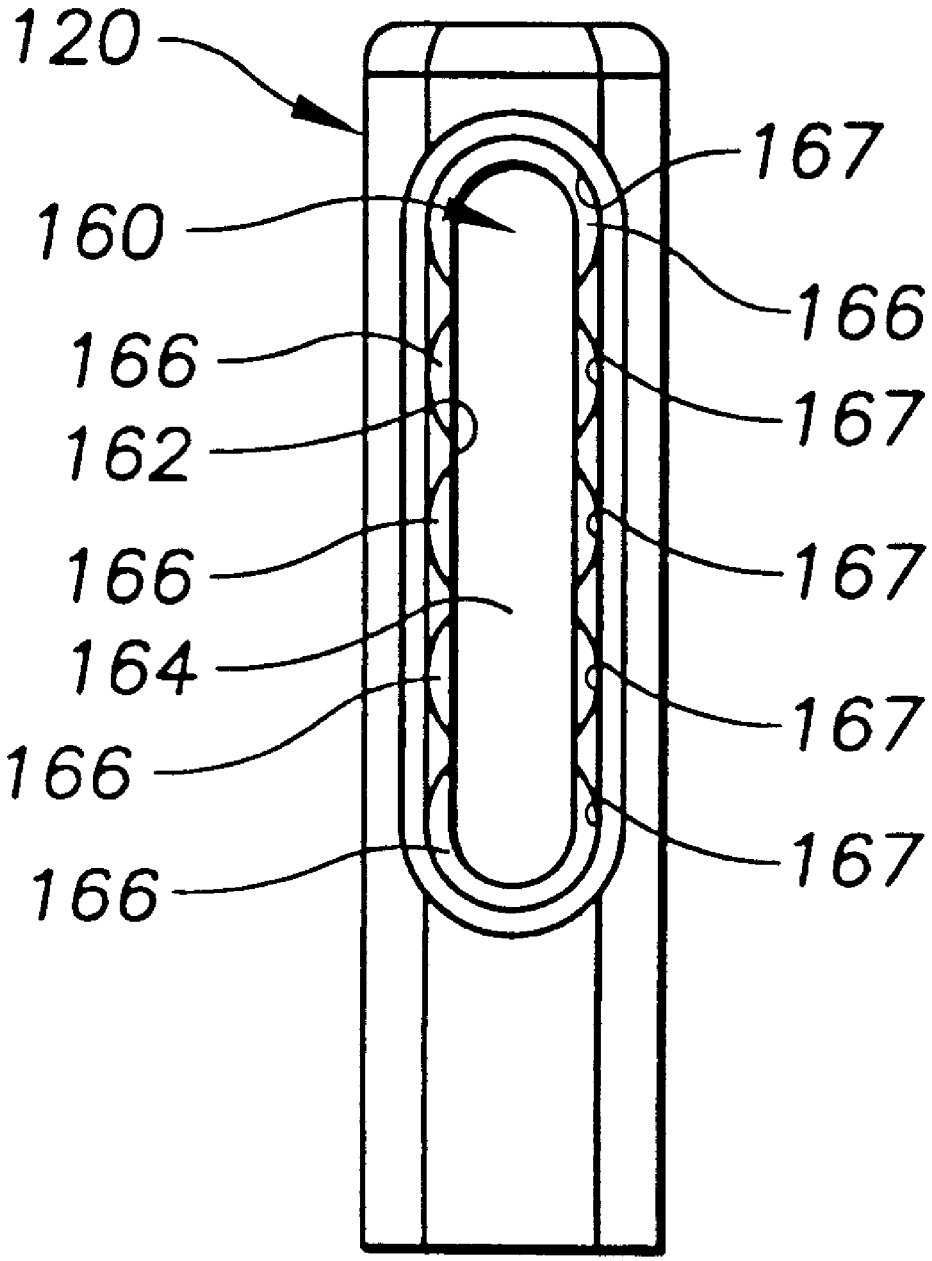
FIG. 4 is a partial sectional view of a prior art magazine.

In FIGS. 1 and 2, the magazine 100 comprises generally a magazine tray 110 including a lower portion 112 having a generally circular shape and a generally circular side wall portion 114 extending upwardly from the lower portion 112. The side wall portion 114 defines an open upper portion of the magazine 100, over which a cover may be removably disposed to enclose a coiled strip of nails therein, not shown in FIGS. 1 and 2 but known generally. Prior art FIG. 4 illustrates for example a known cover 24 removably coupled to the magazine tray 12 to provide access to an interior thereof upon removal of the cover, thereby permitting loading coiled strips of nails therein and adjustment of the magazine for accommodating different sized nails.

The magazine 100 comprises an inner post 120 extending from the magazine tray 110, and more particularly from a generally central portion of the lower portion 112 of the magazine tray. In the exemplary embodiment of FIG. 2, the inner post 120 extends generally perpendicularly from the lower portion 112 of the magazine tray 110, and is fastened thereto by a threaded bolt 20 extending through the lower portion thereof and into the inner post 120. Alternatively, the tray and inner post may be fastened by other means or formed unitarily.

In FIGS. 1 and 2, the magazine 100 also comprises a nail plate 130 having a generally circular shape sized to fit within magazine tray 110, generally parallel to the lower portion 112 thereof for supporting a coiled strip of nails on an upper surface 132 of the nail plate 130, as is known generally. The nail plate 130 includes an outer post 140 extending therefrom, and more particularly extending generally perpendicularly from a generally central portion thereof, about which a coiled strip of nails supported on the nail plate 130 is disposed. In the exemplary embodiment of FIG. 2, the outer post 140 is disposed through a central opening 134 of the nail plate 130, and the nail plate 130 is supported by a radial flange 144 of the outer post 140, and securely retained thereon by a spring clip 145. Alternatively, the nail plate and outer post may be fastened by other means or formed unitarily.

In FIG. 2, the outer post 140 is reciprocatingly disposed about the inner post 120, and more particularly the outer post 140 has an axial bore 142 extending therethrough into which the inner post 120 is disposed. Thus configured, the nail plate 130 and outer post 140 are reciprocatingly disposed about the inner post 120. The axial bore 142 of the outer post 140 preferably extends fully through an upper end portion 143 thereof so that the inner post 120 may protrude therethrough when the nail plate 130 is lowered axially along the inner post 120 toward the lower portion 112 of the magazine tray 110 to accommodate longer length nails. Allowing passage of the inner post 120 through the upper end portion 143 of the outer post 140 permits reducing the overall axial length of the outer post 140, thereby permitting further axial movement of the outer post 140 and nail plate 130 away from the lower portion 112 of the magazine tray 110 without obstruction by a cover of the magazine, than is possible in prior art magazines having cap 22 on the outer post 18.

As discussed above in connection with the magazine in prior art FIG. 4, upwardly movement of the outer post 18 and nail plate 14 relative to the inner post 16 is limited by the magazine cover 24, which eventually obstructs the cap 22 of the outer post 18, thereby limiting the extent that the prior art nail plate 24 may be adjusted upwardly to accommodate shorter nails. In the magazine of the present invention, the absence of a cap on the outer post 140 and the axial bore 142 therethrough permits reducing the axial length of the outer post 140, thereby providing an increased range of upwardly adjustment of the nail plate 130 away from the lower portion 112 of the magazine tray 110 to accommodate shorter nails, without limiting the downwardly adjustment of the nail plate 130 to accommodate longer nails.

The magazine 100 comprises a pin 150 having a first end portion 152 and an opposing second end portion with an enlarged head 154 thereon. The first end portion 152 of the pin is disposed through an opening 146 on a side portion of the outer post 140, and the second end portion of the pin is disposed generally in an axial slot 160 of the inner post. The pin is oriented generally transversely to the axis of the inner and outer posts, and the enlarged head 154 of the pin is seatable in a recess of the axial slot to fix the axial position of the nail plate 130 relative to the inner post 120. In other words, when the enlarged head 154 of the pin 150 is seated in a recess of the axial slot 160, the pin 150 is incapable reciprocating movement along the axial slot, thereby axially fixing the outer post and nail plate, as discussed below.

The magazine 100 also comprises generally a biasing member engaged with the second end portion of the pin to biasingly seat the enlarged head thereof into a recess of the axial slot, whereby the outer post and the nail plate are fixed relative to the inner post when the enlarged head of the pin is seated in the recess of the axial slot. In the exemplary embodiment of FIG. 2, the biasing member is a compressed spring 170 having a first end portion disposed in a recess 147 on a side of the outer post 140 opposite the opening 146 thereof The spring 170 also includes a second opposing end portion engaged with the second end portion of the pin 160, and preferably disposed in a recess 156 of the enlarged head 154 thereof. Thus configured, the outer post 140 carries the pin 150 and the spring 170 as the outer post 140 reciprocates relative to the inner post 120 when the enlarged head 154 thereof is unseated from the recess of the axial slot 160, as discussed more fully below.

In the exemplary embodiment of FIG. 2, the axial slot 160 extends fully through the inner post 120, and the axial slot includes a first slot portion 162 on one side of the inner post 120 and a second slot portion 164 on an opposing side thereof. The first slot portion 162 is sized to accommodate the first end portion 152 of the pin 150 but not the enlarged head 154 thereof, and the second slot portion is sized to accommodate the enlarged head of the pin. The recess into which the enlarged head 154 is seatable under the bias of the biasing member to axially fix the outer post 140 relative to the inner post 120 is formed between the first and second slot portions 162 and 164 of the inner post 120.

When the outer post 140 is reciprocatingly disposed about the inner post 120, the opening 146 of the outer post 140 is aligned with the first slot portion 162 and the recess 147 of the outer post 140 is aligned with second slot portion 164. Thus assembled, the enlarged head 154 on the second end portion of the pin 150 may be seated into a recess of the inner post 120 by the biasing action of the compressed spring 170 disposed between the second end portion of the pin 150 and the outer post 140. The enlarged head 154 of the pin prevents passage thereof through the first slot portion 162 under the bias of the compressed spring 170.

Figure 3:
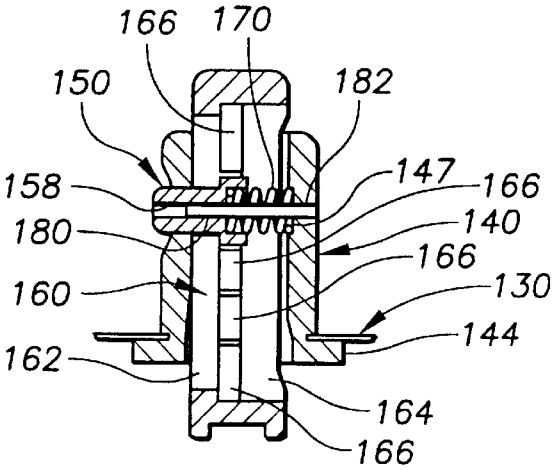
FIG. 3 is a partial view of an inner post according to the invention.

In FIGS. 2 and 3, the axial slot 160 of the inner post 120 preferably comprises a series of recesses 166 formed between the first and second slot portions 162 and 164. The compressed spring 170, engaged with the second end portion of the pin 150, thus biases the enlarged head 154 thereof into one of the recesses 166 of the axial slot 160, depending on the desired axial position of the nail plate 130 relative to the inner post 120. The recesses 166 each have a wall portion 167 engageable with the enlarged head 154 of the pin to prevent movement of the pin along the axial slot 160 of the inner post 120, thereby fixing the axial position of the outer post and hence the axial position of the nail plate relative to the post 120.

In FIG. 2, the pin 150 is movable against the bias of the biasing member, which is the compressed spring 170 in the exemplary embodiment, upon depressing the first end portion 152 of the pin 150 protruding from the opening 146 of the outer post 140 to unseat the enlarged head 154 of the pin 150 from one of the recesses 166 of the axial slot 160. When the enlarged head 154 of the pin is unseated from the recesses 166 of the axial slot, the enlarged head 154 is moved into the second slot portion 164 of the axial slot, where the enlarged head of the pin is free to reciprocate along the axial slot 160 relative to the inner post 120, thereby permitting adjustment of the nail plate 130 for accommodating a particular fastener or nail size in the magazine 100. When the nail plate 130 is moved to the desired position relative to the inner post 120, the pin 150 is released, allowing the biasing member to bias enlarged head of the pin into one of the recesses 166 of the axial slot 160, whereupon the nail plate 130 is fixed relative to the inner post 120 and relative to the lower portion 112 of the magazine tray 110.

While the foregoing description of the invention enables one of ordinary skill to make and use what is considered presently to be the best mode thereof, those of ordinary skill will understand and appreciate the existence of variations, combinations, and equivalents of the exemplary embodiments herein. The invention is therefore to be limited not by the exemplary embodiments, but by all embodiments within the scope and spirit of the claims.

What is claimed is:

1. A magazine for a coiled strip of nails useable in a nailing tool, comprising:

a magazine tray;

an inner post extending from the magazine tray, the inner post having an axial slot in a side portion thereof, the axial slot having a recess formed therein;

a nail plate having an outer post extending therefrom, the outer post reciprocatingly disposed about the inner post, the outer post having an opening through a side portion thereof;

a pin having a first end portion and an opposing second end portion with an enlarged head thereon, the first end portion of the pin disposed through the opening of the outer post, the second end portion of the pin disposed in the axial slot of the inner post, the enlarged head of the pin seatable in the recess of the axial slot; and a biasing member engaged with the second end portion of the pin to biasingly seat the enlarged head of the pin in the recess of the axial slot, whereby the nail plate is fixed relative to the inner post when the enlarged head of the pin is seated in the recess of the axial slot.

2. The magazine of claim 1, the axial slot extends through the inner post, the axial slot having a first slot portion on one side of the inner post and a second slot portion on an opposing side of the inner post, the first slot portion accommodating the first end portion of the pin but not the enlarged head thereof, and the second slot portion accommodating the enlarged head of the pin, the recess formed between the first and second slot portions.

3. The magazine of claim 2, the axial slot having a series of recesses formed between the first and second slot portions, the biasing member engaged with the second end portion of the pin to bias the enlarged head of the pin into one of the recesses of the axial slot, the pin movable against the bias of the biasing member to unseat the enlarged head from a recess of the axial slot, whereby the nail plate is movable relative to the inner post when the enlarged head is unseated from the recess of the axial slot.

4. The magazine of claim 3, the outer post having a recess opposite the opening in the outer post, the biasing member is a compressed spring having a first end portion disposed in the recess of the outer post, the compressed spring having a second opposing end portion disposed in a recess of the enlarged head of the pin.

5. The magazine of claim 1, the pin is oriented transversely to an axis of the inner post.

6. The magazine of claim 1, the magazine tray has a lower portion with a generally circular shape, the inner post protrudes from a generally central portion of the lower portion of the magazine tray, the nail plate has a generally circular shape, and the outer post protrudes generally perpendicularly from a central portion of the nail plate.

7. The magazine of claim 1, the outer post has an axial bore therethrough, the inner post disposed in the axial bore of the outer post.

8. A nailing tool having a magazine for a coiled strip of nails, comprising:

a magazine tray;

an inner post extending from the magazine tray, the inner post having an axial slot in a side portion thereof, the axial slot having a recess formed therein;

a nail plate having an outer post extending therefrom, the outer post reciprocatingly disposed about the inner post, the outer post having an opening through a side portion thereof;

a pin having a first end portion and an opposing second end portion with an enlarged head thereon, the first end portion of the pin disposed through the opening of the outer post, the second end portion of the pin disposed in the axial slot of the inner post, the enlarged head of the pin seatable in the recess of the axial slot; and a biasing member engaged with the second end portion of the pin to biasingly seat the enlarged head of the pin in the recess of the axial slot, whereby the nail plate is fixed relative to the inner post when the enlarged head of the pin is seated in the recess of the axial slot.

9. The tool of claim 8, the axial slot extends through the inner post, the axial slot having a first slot portion on one side of the inner post and a second slot portion on an opposing side of the inner post, the first slot portion accommodating the first end portion of the pin but not the enlarged head thereof, and the second slot portion accommodating the enlarged head of the pin, the recess formed between the first and second slot portions.

10. The tool of claim 9, the axial slot having a series of recesses formed between the first and second slot portions, the biasing member engaged with the second end portion of the pin to bias the enlarged head of the pin into one of the recesses of the axial slot, the pin movable against the bias of the biasing member to unseat the enlarged head from a recess of the axial slot, whereby the nail plate is movable relative to the inner post when the enlarged head is unseated from the recess of the axial slot.

11. The tool of claim 10, the outer post having a recess opposite the opening in the outer post, the biasing member is a compressed spring having a first end portion disposed in the recess of the outer post, the compressed spring having a second opposing end portion disposed in a recess of the enlarged head of the pin.

12. The tool of claim 8, the pin is oriented transversely to an axis of the inner post.

13. The tool of claim 8, the magazine tray has a lower portion with a generally circular shape, the inner post protrudes from a generally central portion of the lower portion of the magazine tray, the nail plate has a generally circular shape, and the outer post protrudes generally perpendicularly from a central portion of the nail plate.

14. The tool of claim 8, the outer post has an axial bore therethrough, the inner post disposed in the axial bore of the outer post.

15. A method for a magazine useable for housing a coiled strip of nails in a nailing tool, comprising:

reciprocatingly disposing an outer post extending from a nail plate about an inner post extending from a magazine tray;

axially fixing the outer post relative to the inner post with a pin having an enlarged head seatable in a recess of an axial slot through the inner post, the pin having a first end portion disposed in an opening the outer post; and biasing the enlarged head of the pin into the recess of the axial slot.

16. The method of claim 15, adjusting the axial position of the nail plate relative to the inner post by depressing the pin against the bias to unseat the enlarged head thereof from a recess of the axial slot to permit reciprocating adjustment of the outer post relative to the inner post.

17. The method of claim 16 further comprising reseating the enlarged head of the pin in another recess of the axial slot after adjusting the nail plate relative to the inner post.

18. The method of claim 15, biasing the enlarged head of the pin with a compressed spring member disposed between the enlarged head and the outer post.

19. The method of claim 18, supporting an end portion of the compressed spring in a recess in the outer post opposite the opening thereof, and supporting an opposing end of the compressed spring in a recess in the enlarged head of the pin.

* * * * *